US006073471A

United States Patent [19]

Naka et al.

[11] Patent Number: 6,073,471

[45] Date of Patent: Jun. 13, 2000

[54] ELECTRICAL WIRE-CRIMPING DEVICE

[75] Inventors: Shigeru Naka, Chiba; Hiromi Tanaka, Tokyo, both of Japan

[73] Assignee: The Whitaker Corporation, Wilmington, Del.

[21] Appl. No.: 09/348,417

[22] Filed: Jul. 7, 1999

[30] Foreign Application Priority Data

Jul. 7, 1998 [JP] Japan ..... 10-191325

[51] Int. Cl.[7] ..... B21D 55/00

[52] U.S. Cl. ..... 72/21.3; 72/3; 72/31.11; 72/37; 29/715; 29/753

[58] Field of Search ..... 72/3, 17.1, 17.2, 72/20.1, 20.2, 21.1, 21.3, 31.01, 31.1, 31.11, 37, 412, 413, 414, 441; 29/705, 715, 753, 863

[56] References Cited

U.S. PATENT DOCUMENTS 5,168,736 12/1992 Enneper et al. ..... 72/21.3
5,353,625 10/1994 Hoshino et al. ..... 72/416
5,669,257 9/1997 Inoue et al. ..... 72/20.1
5,704,110 1/1998 Erhard et al. ..... 29/753
5,852,868 12/1998 Soriano ..... 72/442

*Primary Examiner*—Ed Tolan

[57] ABSTRACT

A wire-crimping device detects if an electrical terminal is stuck to a crimper after crimping, thereby effectively eliminating deformed terminals. Electrical wire-crimping device (1) has a ram (42) slidably mounted to a housing (4). A reflection light sensor (60) is mounted to the housing (4), and a pathway (80) that communicates with a wire-crimping member (40) is located in the ram (42). If an electrical terminal (30) should stick to crimpers (50, 52) after crimping, and if the wire-crimping member (40) mounted to the ram (42) rises, a wire depressor (54) will also rise, and an upper end of the wire depressor (54) will block the pathway (80). As a result, the light emitted from the reflection light sensor (60) will be reflected and detected by a light sensor, and it will be electrically detected that a defective part has been produced.

6 Claims, 6 Drawing Sheets

ELECTRICAL WIRE-CRIMPING DEVICE

FIELD OF THE INVENTION

The present invention relates to an electrical wire-crimping device, and more particularly to an electrical wire-crimping device having a wire depressor.

BACKGROUND OF THE INVENTION

The wire-crimping device 100 disclosed in Japanese Utility Model Publication No. 1-106093 and shown in FIG. 9 is a known device that crimps an electrical terminal onto an end of an insulated electrical wire. Wire-crimping device 100 has an insulation crimper 102, a wire crimper 104, and a wire depressor 106 that is disposed between the crimpers 102, 104. The wire depressor 106 slides between the crimpers 102, 104 and is constantly urged downward by a spring. When the crimpers 102, 104 rise after the wire has been crimped to an electrical terminal, the end of the terminated wire (not shown) is pressed down by the wire depressor 106 and ejected from the crimpers 102, 104.

After the electrical terminal has been crimped onto the insulated electrical wire, the end of the terminated wire may not drop smoothly out of the crimpers 102, 104 even though it is pressed on by the wire depressor 106. This is caused by a barrel of the crimped terminal sticking to one or both of the crimpers 102, 104 and not coming loose. Consequently, the end of the wire may rise along with the crimpers 102, 104, and the terminal crimped thereto may engage and deform other terminals.

The present invention overcomes this situation, and an object thereof is to provide a wire-crimping device which will detect if a terminal is stuck to a crimper, thereby effectively eliminating deformed and defective terminals.

SUMMARY OF THE INVENTION

The electrical wire-crimping device of the present invention includes a wire crimper and an insulation crimper, a wire depressor slidably disposed therebetween and moving so as to eject a terminated wire after an electrical terminal has been crimped onto an end of an insulated electrical wire, wherein detection means for detecting a malfunction of the wire depressor after completion of the crimping operation is provided.

The detection means can be a reflection light switch.

The detection means can also be a light-transmission sensor that detects deformation of an electrical terminal due to blockage of an optical path by the wire depressor.

The detection means can further be a proximity switch disposed in the proximity of the wire depressor.

The detection means can additionally be a limit switch that is engaged by the wire depressor.

BRIEF DESCRIPTION OF THE DRAWINGS

Embodiments of the present invention will now be described by way of example with reference to the accompanying drawings in which:

FIGS. 2*a*–2*e* illustrate how an electrical terminal is crimped onto an insulated electrical wire, wherein FIG. 2*a* is a part view of an anvil, a wire-crimping member and a wire-crimping section of an electrical terminal and an insulated electrical wire when viewed from arrow A in FIG. 1, whereby the wire-crimping member is in its initial state prior to the crimping of the electrical terminal onto the insulated electrical wire; FIG. 2*b* is the same front view as FIG. 2*a* just prior to the wire-crimping section being crimped onto the insulated electrical wire; FIG. 2*c* is the same view as FIG. 2*a* showing a state in which the electrical terminal is crimped onto the insulated wire; FIG. 2*d* is the same view as FIG. 2*a* showing a state in which the wire-crimping member has begun to rise upon completion of the crimping operation; and FIG. 2*e* is the same view as FIG. 2*a*, whereby the wire-crimping member is in the same position as in FIG. 2*d*; however, the electrical terminal has stuck to the wire-crimping member and risen therealong.

FIG. 8*a* illustrates a state of normal crimping and FIG. 8*b* illustrates a state of defective crimping.

DETAILED DESCRIPTION OF THE INVENTION

Figure 1:
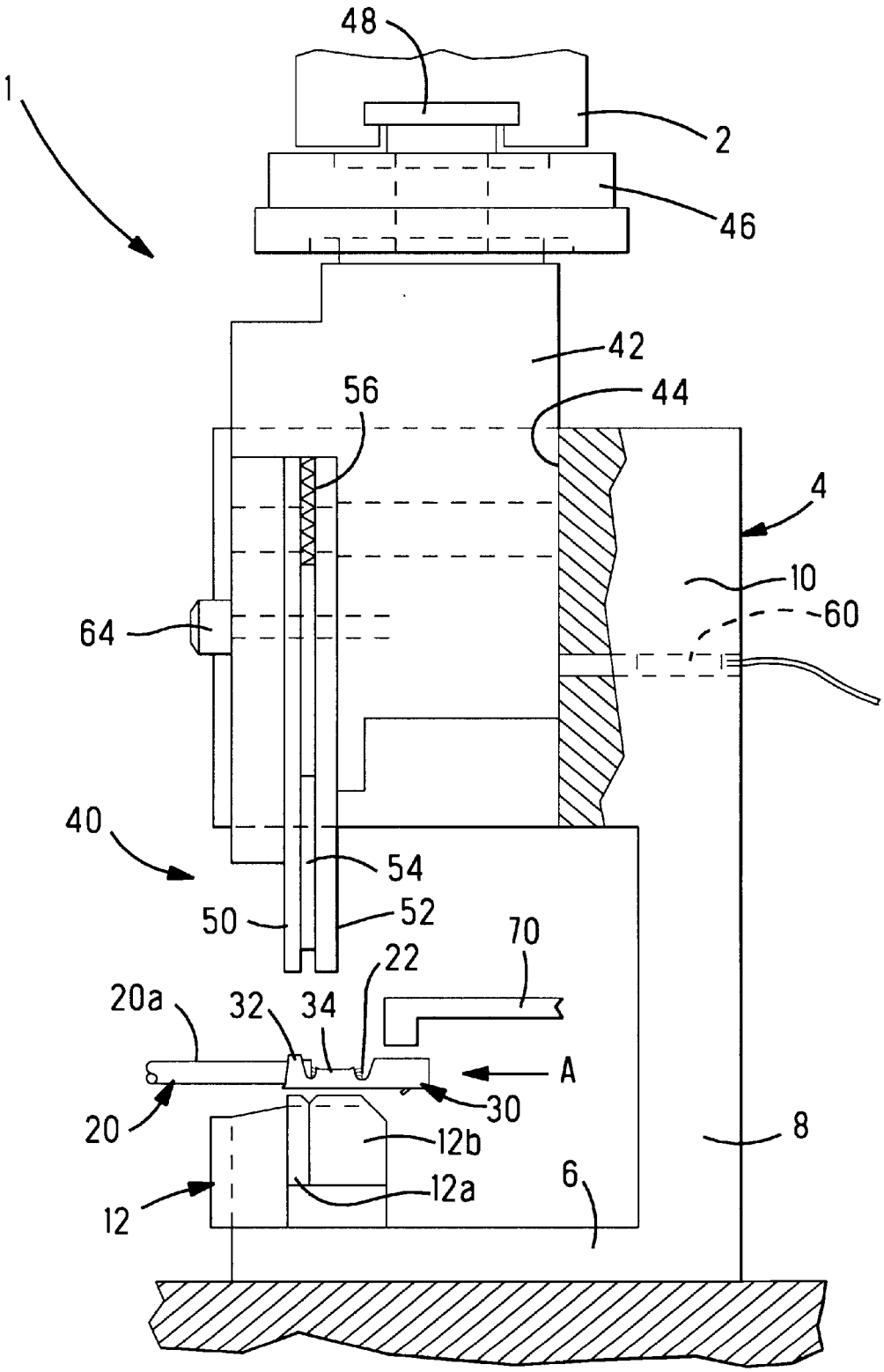
FIG. 1 is a side view of an electrical wire-crimping device of the present invention.

FIG. 1 is a side view of a first embodiment of an electrical wire-crimping device or machine 1 of the present invention. The basic structure is the same as that of known wire-crimping devices. A brief description of the structure follows. Housing 4 of the device 1 has a base 6, a support 8 that rises upward from the base 6, and a guide 10 provided on the support 8. An anvil 12 is mounted to the base 6, and an electrical terminal 30 is crimped to a distal end of an insulated electrical wire 20 through cooperation with a wire-crimping member 40 on anvil 12 as shown in FIG. 1. The anvil 12 has an insulation anvil 12*a* and a wire anvil 12*b* that respectively support an insulation barrel 32 and wire barrel 34 of the electrical terminal 30.

The guide 10 is disposed facing the base 6, and has a guide opening 44 that slidably accommodates a reciprocating ram 42. The wire-crimping member 40 is mounted to the ram 42. The ram 42 is provided at the upper portion thereof with an attachment flange 48 via an adjusting dial 46 for adjusting crimp height. The attachment flange 48 engages with a press ram 2, and the ram 42 is attached to the press ram 2. When the press ram 2 moves up and down, the ram 42 also moves up and down therewith, which results in the wire-crimping member 40 moving closer to or away from the anvil 12 from above the anvil 12.

The wire-crimping member 40 has an insulation crimper 50, a wire crimper 52, and a wire depressor 54 slidably disposed between the crimpers 50, 52. The insulation crimper 50 crimps insulation barrel 32 of the electrical terminal 30 to insulation 20*a* of an electrical wire 20 via insulation anvil 12*a*, and the wire crimper 52 crimps wire barrel 34 of the electrical terminal 30 to conductive core 22 of the electrical wire 20 via wire anvil 12*b*. A restricting member 70, that is attached to the housing 4 in order to restrict the upward movement of the electrical terminal 30, is disposed above the electrical terminal 30.

Figure 4:
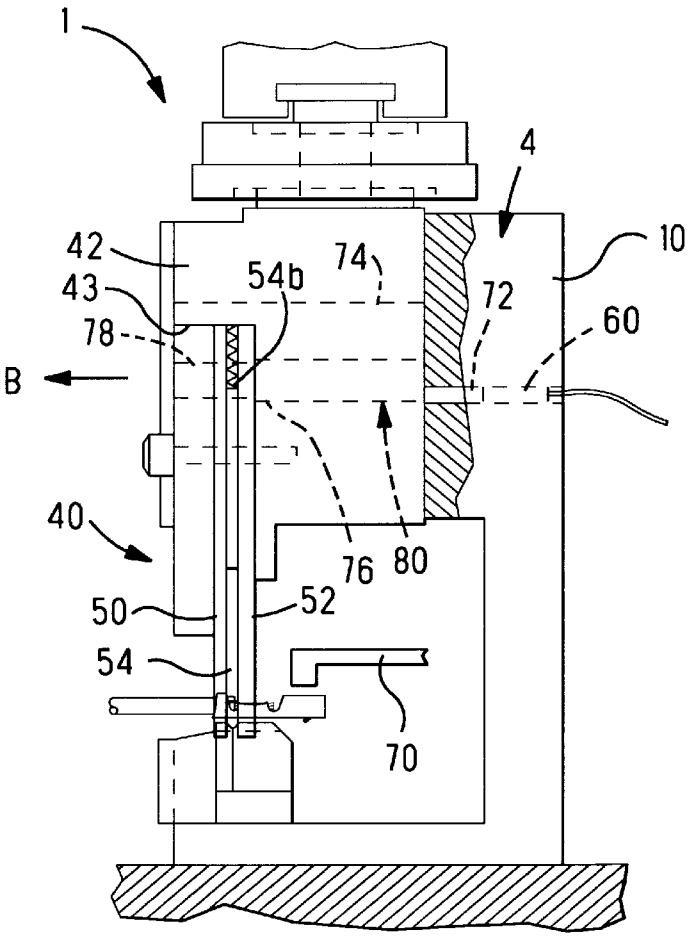
FIG. 4 is a side view illustrating the electrical wire-crimping device of the present invention and in which a reflection light sensor is attached to the housing.

The wire depressor 54 is constantly urged downward by a coil spring 56 disposed between the wire crimper 52 and the insulation crimper 50. The operation of the wire depressor 54 will be discussed below. In the embodiment of FIG. 4, a reflection light sensor 60 is mounted in the guide 10 of the housing 4; the operation thereof will be discussed below. Next, a state in which the electrical terminal 30 is crimped to the electrical wire 20 will be described through reference to FIGS. 2*a*–2*e*.

Figure 2A:
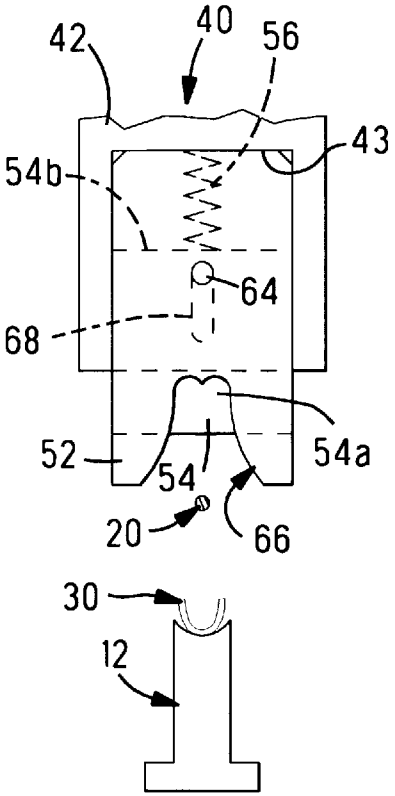

The various steps of crimping will now be described in order. In FIG. 2*a*, the electrical terminal 30 has been placed on the anvil 12, and the electrical wire 20 is above the electrical terminal 30. The wire crimper 52 has been fixed by a bolt 64 to the ram 42 of the wire-crimping member 40, and it has a crimping depression 66 for crimping the electrical terminal 30. The shape of crimping depression 66 is already known and will therefore not be described in detail. The wire depressor 54 is in the form of a rectangular plate, it has a lower end 54*a* and an upper end 54*b*, and it is provided with a slot 68 that accommodates the bolt 64. The wire depressor 54 is able to move up and down within the range of the slot 68, but it is urged downward by the coil spring 56. The coil spring 56 is disposed between the upper end 54*b* of the wire depressor 54 and a downward-facing shoulder 43 of the ram 42.

Figure 2B:
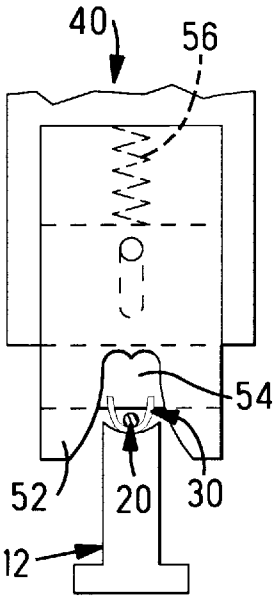

When the wire-crimping member 40 moves from the position shown in FIG. 2*a* to the position shown in FIG. 2*b*, that is, when the press ram 2 of FIG. 1 is driven and moves down, the lower end 54*a* of the wire depressor 54 moves so that the electrical wire 20 is pushed into the barrels 32, 34 of the electrical terminal 30.

Figure 2C:
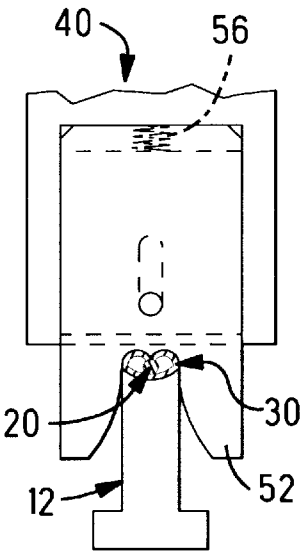

When the wire-crimping member 40 descends further, as shown in FIG. 2*c*, the wire crimper 52, and, although the insulation crimper 50 cannot be seen in FIG. 2*c*, the wire crimper 52 and the insulation crimper 50 crimp the wire barrel 34 and the insulation barrel 32, respectively, of the electrical terminal so that the end of the electrical wire 20 is terminated to the electrical terminal 30. The wire depressor 54 keeps the electrical wire 20 in a pressed state during the time from FIG. 2*b* to FIG. 2*c*, but the coil spring 56 is compressed as the crimpers 50, 52 descend.

Figure 2D:
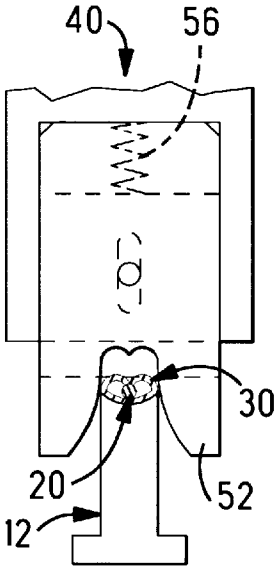

Next, when the wire-crimping member 40 begins to rise as shown in FIG. 2*d*, the crimping edge 66*a* of the crimping depression 66 moves away from the electrical terminal 30 attached to the wire 20, while the terminal 30 attached to the electrical wire 20 remains on the anvil 12. When the crimpers 50, 52 rise, the wire depressor 54 remains relatively in a state in which the wire 20, that is, the terminal 30, is being pressed. The wire-crimping member 40 thereafter returns to the position shown in FIG. 2*a*, and the wire 20 to which the terminal 30 has been crimped is ejected. A state of normal crimping is therefore illustrated by FIGS. 2*a*–2*d*.

However, if the crimped terminal 30 sticks to the crimping edge 66*a* of the crimping depression 66, the terminal 30 crimped to the wire 20 will rise along with the crimpers 50, 52. This occurs when the sticking force is greater than the depressing force of the wire depressor 54. Because the rising terminal 30 is restrained by the restricting member 70, the terminal 30 is pressed downward and deformed, and as a result the product becomes defective.

Figure 3:
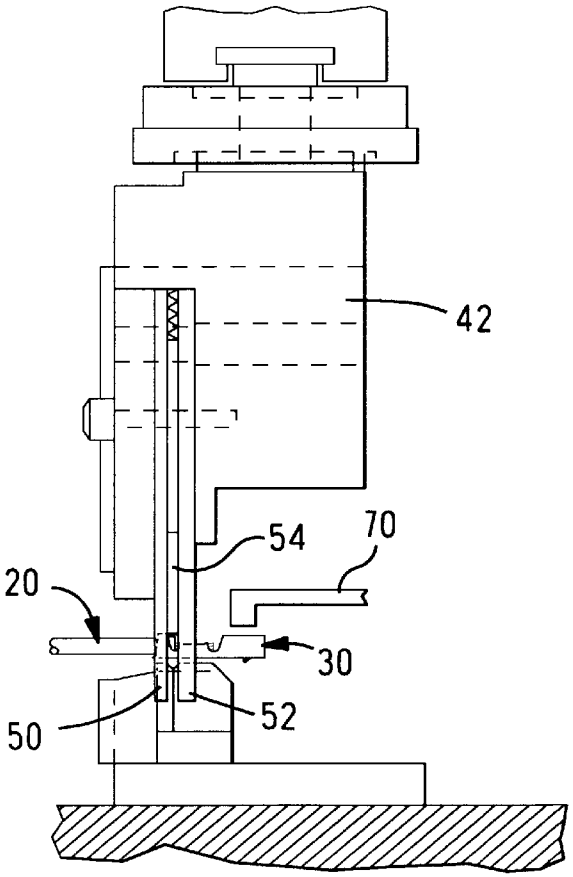
FIG. 3 illustrates the main components in a state in which the electrical terminal has been crimped to the insulated electrical wire and is a part side view corresponding to FIG. 2*c*.

Next, the reflection light sensor 60 as a detection means will be described with reference to FIGS. 3–5. FIG. 3 illustrates the main components in a state in which the terminal 30 has been crimped to the wire 20 and is a part side view corresponding to FIG. 2*c*. The ram 42 at this point has descended to the lowermost end, and the coil spring 56 is in its state of greatest compression by the upper end 54*b* of the wire depressor 54.

FIG. 4 is a side view illustrating a state in which the reflection light sensor 60 is mounted to the housing 4. The reflection light sensor 60 has a light-emitting component and a light-receiving component (not shown), and the presence of an object is detected by the light emitted from the light-emitting component being reflected by the object, and the reflected light being detected by the light-receiving component. A through hole 72 is made in the housing 4 from the back side thereof toward the crimping member 40. The reflection light sensor 60 is inserted in and mounted within the through hole 72. In FIG. 4, the ram 42 is in a slightly elevated position after crimping, corresponding to FIG. 2*d*. A sight hole 74, that is larger in diameter than the through hole 72 and is aligned with the through hole 72 when the ram 42 is in this state, is located in the ram 42. Holes 76, 78 that align with the sight hole 74, are located in the wire crimper 52 and the insulation crimper 50, respectively.

Since the terminal 30 is not now stuck to the wire-crimping member 40 in this state, the wire depressor 54 is biased downward in engagement with the terminal 30. Therefore, the upper end 54*b* of the wire depressor 54 does not block the pathway 80 made up of the sight hole 74 and the holes 76, 78. The light emitted by the reflection light sensor 60 therefore passes in a single direction as indicated by the arrow B, so the detection circuit (not shown) does not detect the presence of the wire depressor 54 in the pathway 80.

Figure 5:
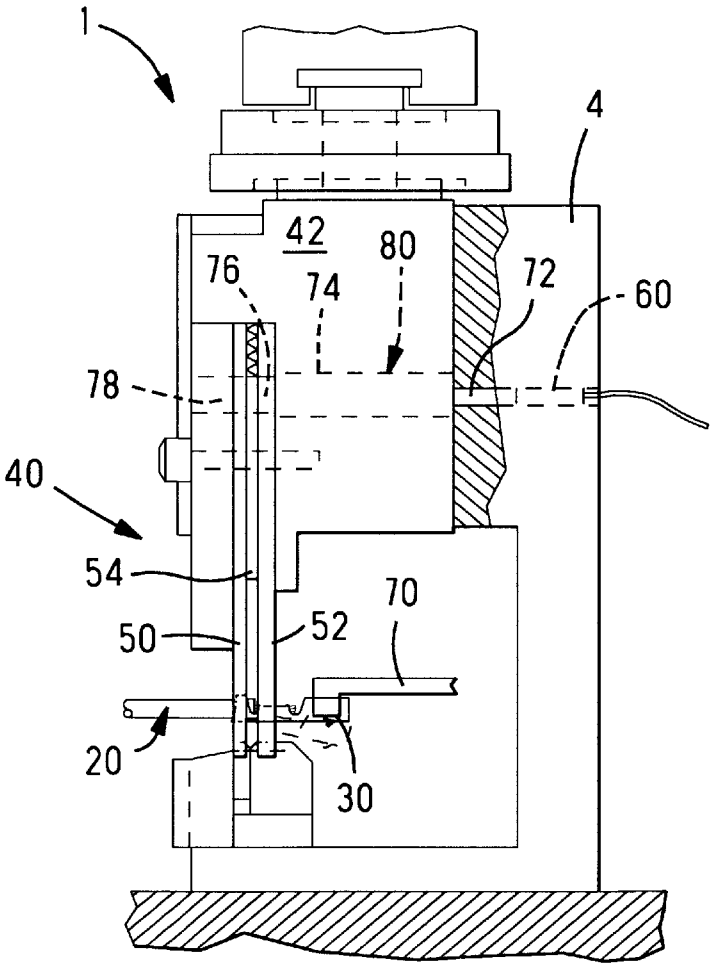
FIG. 5 is the same side view as in FIG. 4, illustrating a state in which the electrical terminal has stuck to the crimping members and risen along with the crimping members.

Meanwhile, referring to the same side view in FIG. 5 as in FIG. 4, the ram 42 is in the same position as in FIG. 4. The difference from FIG. 4 is that the terminal 30 has stuck to the crimpers 50, 52 and risen along with them, which corresponds to FIG. 2*e*. The rising terminal 30 engages the restricting member 70 and is deformed as indicated by the imaginary line. In this case, the wire depressor 54 blocks the pathway 80 because it is still elevated. As a result, the light emitted from the reflection light sensor 60 is reflected by the wire depressor 54, and the reflected light is detected. Therefore, a crimping defect is electrically detected, the device is halted by a control circuit (not shown), and the terminal 30 is taken out as a reject by the operator.

Figure 6:
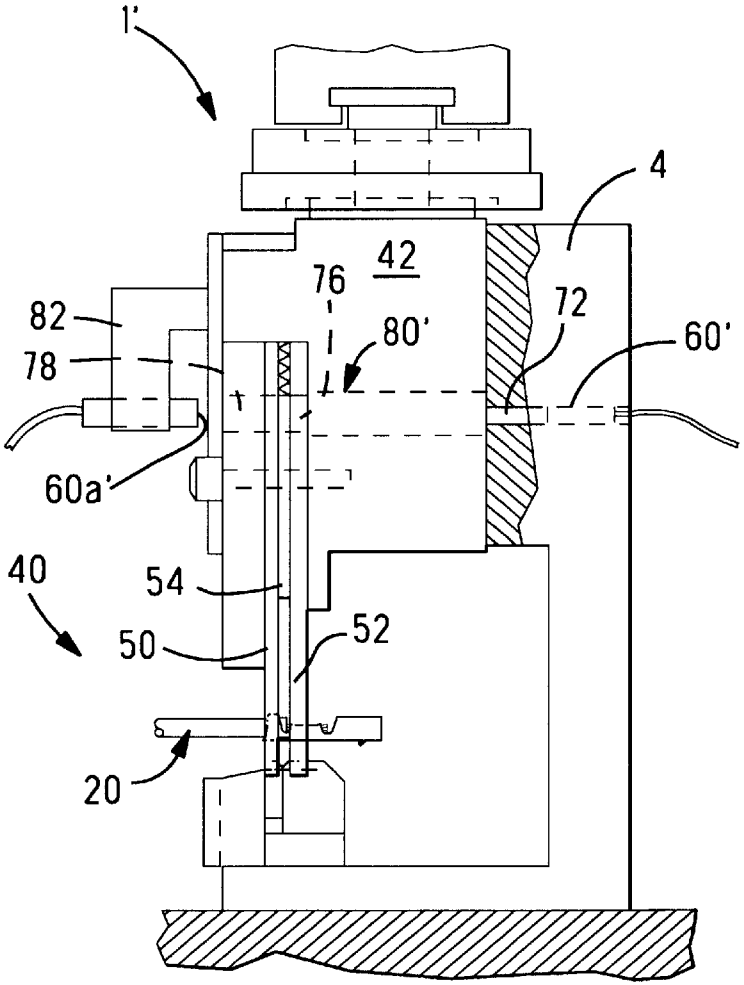
FIG. 6 is the same side view as in FIG. 5, illustrating an alternative embodiment of the electrical wire-crimping device of the present invention, wherein a transmission light sensor is attached to the housing.

The electrical wire-crimping device 1' as an alternative embodiment will now be described with reference to FIG. 6, and the same reference numbers will be used for the same parts. FIG. 6 is the same side view as in FIG. 5, where a light-emitting member 60' and a light-receiving member, namely, a light sensor 60*a*', are mounted to the housing 4 as a detection means. The difference from FIG. 5 is that the light-emitting member 60' is used, and the light-receiving member 60*a*' is on the opposite side from the light-emitting member 60'. The light-receiving member 60*a*' is positioned in the pathway 80' and mounted to the housing 4 by a bracket 82. Here, the terminal 30 is stuck to the crimpers 50, 52, and the crimpers 50, 52 and the wire depressor 54 are in the same position as shown in FIG. 5. The wire depressor 54 therefore blocks the pathway 80' just as in FIG. 5, the light emitted toward the light-receiving member 60*a*' is blocked, and any defective crimping is electrically detected by a detection circuit (not shown).

The electrical wire-crimping device 1" as another embodiment will now be described with reference to FIG. 7, which is the same side view as FIG. 5 and wherein a proximity sensor 84 is used. A through hole 86, which expands in size in the up and down direction, that is, in the direction of movement of the ram 42, and which accommodates lead 84a of the proximity sensor 84, is located in the housing 4. A small-diameter mounting hole 87 is provided in the ram 42 at a position corresponding to the pathway 80, and the proximity sensor 84 is mounted by insertion in the mounting hole 87. Holes 76, 78 are located in the crimpers 50, 52 just as in the embodiments of FIGS. 5 and 6. The proximity sensor 84 is disposed such that its distal end 84*b* is located adjacent the wire crimper 52 in the proximity of the wire depressor 54.

Figure 7:
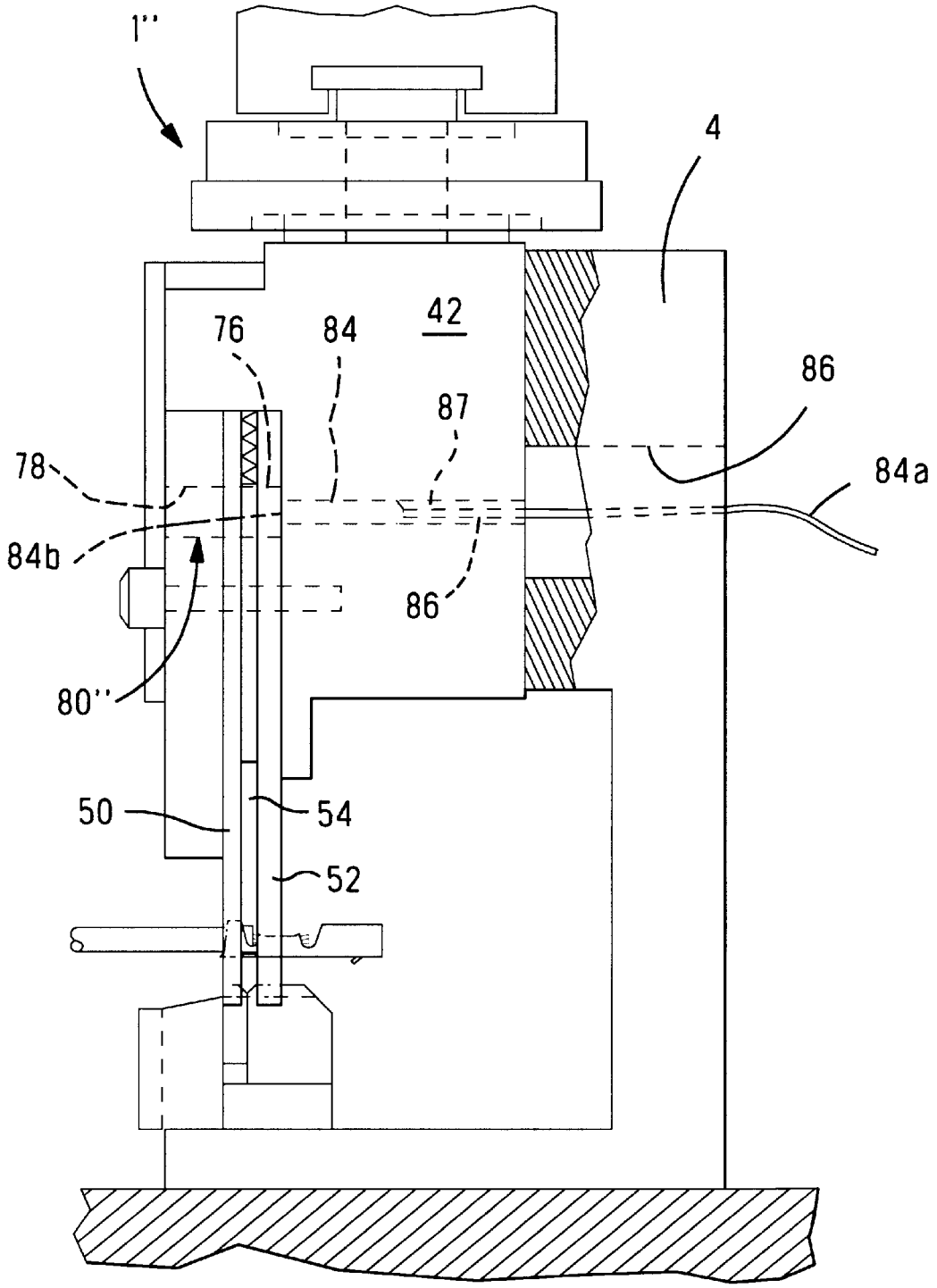
FIG. 7 is the same side view as in FIGS. 5 and 6, illustrating another embodiment of the electrical wire-crimping device of the present invention, wherein the electrical terminal has stuck and risen along with the crimping members.

FIG. 7 shows a state of defective crimping where the terminal 30 has stuck and risen, just as in FIGS. 5 and 6, and the proximity sensor 84 is able to detect by a detection circuit (not shown) the rise of the wire depressor 54, that is, that the wire depressor 54 has not moved down and is blocking the pathway 80".

Figure 2E:
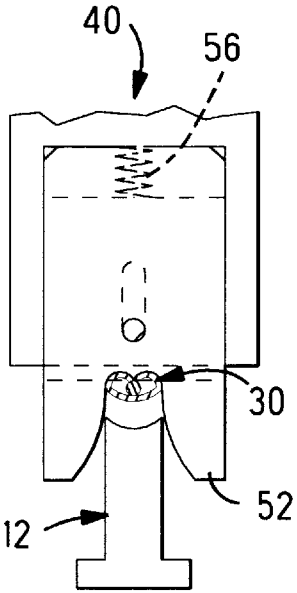
Figure 8A:
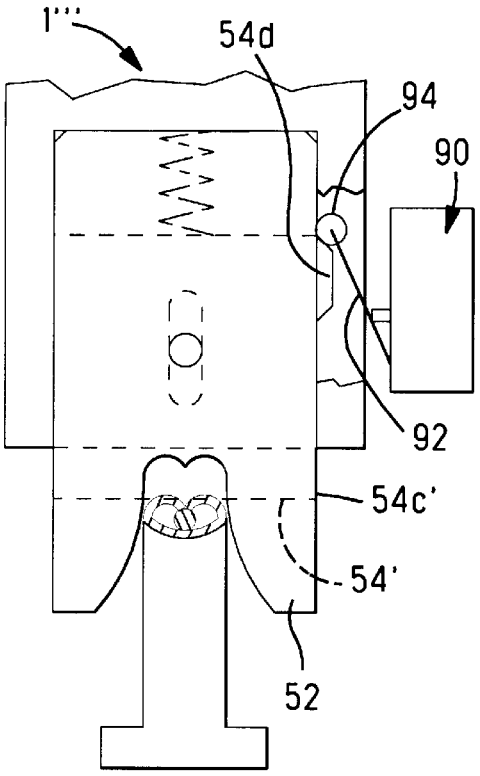
FIGS. 8*a* and 8*b* are the same front view of the crimping components as in FIG. 2, illustrating a further embodiment in which a limit switch is used.

The electrical wire-crimping device 1'" is a further embodiment, wherein a limit switch 90 as a detection means is used and will now be described with reference to FIGS. 8*a* and 8*b* which are respectively the same front view as in FIG. 2*d*, illustrating a normally-crimped state and the same front view as in FIG. 2*e*, illustrating a state in which the terminal is stuck. The limit switch 90 has a roller 94 mounted to a distal end of an arm 92, which engages a side edge 54*c*' of the wire depressor 54' mounted to the ram 42. A protrusion 54*d* is located on the side edge 54*c*' of the wire depressor 54'. When the crimping is normal as in FIG. 8*a*, the wire depressor 54' does not rise when the crimpers 50, 52 rise after crimping, so the protrusion 54*d* stays where it is. Therefore, the roller 94 is not pushed inwardly.

Figure 8B:
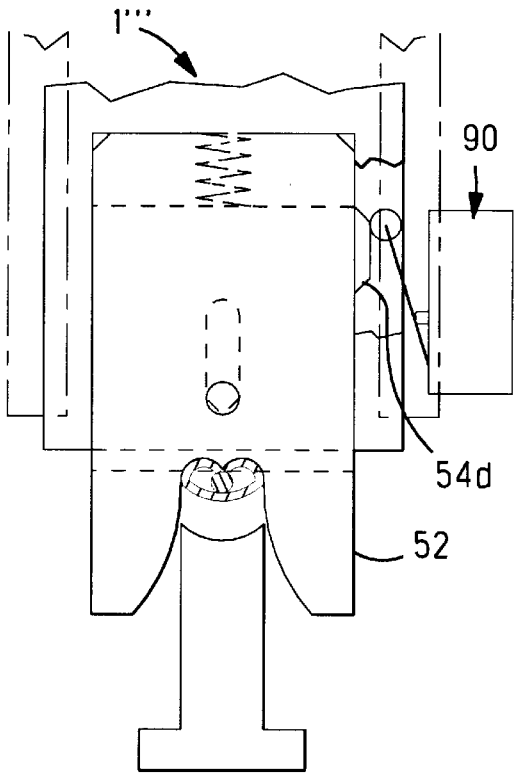
Figure 9:
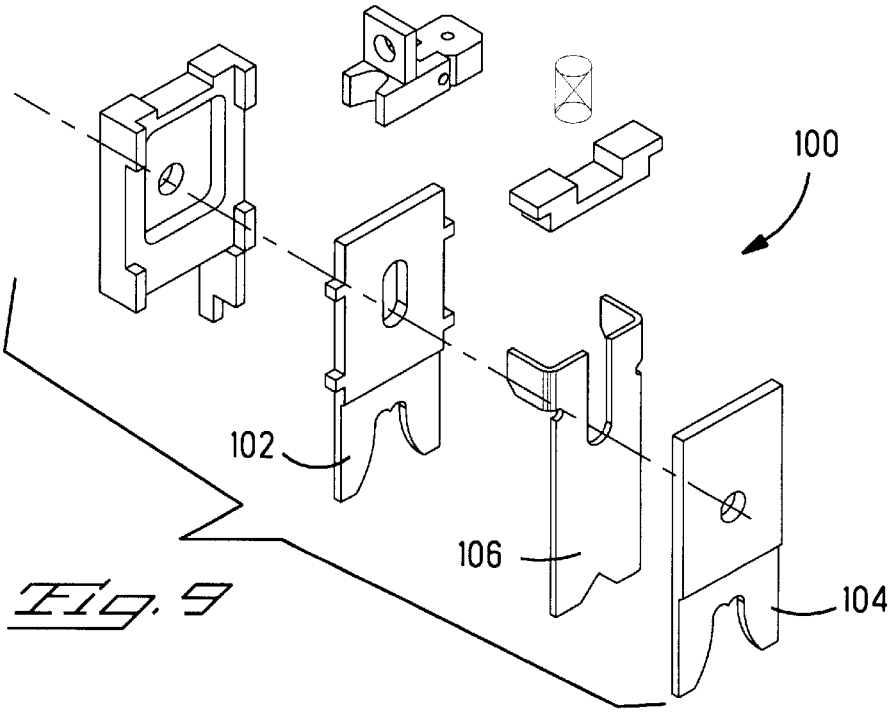
FIG. 9 is a perspective exploded view of components of a prior art wire-crimping device.

When the crimping has not been carried out normally, the wire depressor 54' rises along with the crimpers 50, 52 as in FIG. 8*b*, so the protrusion 54*d* pushes the roller 94 inwardly and actuates the limit switch 90. A defective crimp is detected by the detection of this state immediately after crimping.

The electrical wire-crimping device of the present invention has been described in detail above, but a person skilled in the art readily understands that various changes and modifications are possible within the scope of the present invention. For example, the detection means may be mounted to the ram 42 instead of being mounted to the housing 4 as described above.

The electrical wire-crimping device of the present invention has detection means for detecting a malfunction of the wire depressor after crimping, so that deformed electrical terminals are not shipped out as finished products. Products with more reliable electrical performance are therefore obtained. Productivity is enhanced because no labor is required for visually inspecting a manufactured wiring harness.

What is claimed is:

1. A wire-crimping device for crimping an electrical wire to an electrical terminal comprising a frame, an anvil mounted on the frame on which a crimping section of the electrical terminal is positioned;

a ram reciprocably mounted on the frame;

a wire-crimping member mounted on the ram opposite the anvil for crimping the crimping section of the electrical terminal to the electrical wire when the ram moves the wire-crimping member onto the crimping section;

a wire depressor mounted along the wire-crimping member and movable therewith;

a spring member urges the wire depressor into engagement with the electrical wire thereby pressing the electrical wire into the crimping section prior to the wire-crimping member engaging the crimping section, during the crimping action by the wire-crimping member crimping the crimping section onto the electrical wire and for a short distance as the wire-crimping member moves away from the crimping section; and detecting means mounted on the frame for detecting that the wire depressor has not returned to an original operating position signifying that the crimped connection has not been ejected from the wire-crimping member.

2. A wire-crimping device as claimed in claim 1, wherein the detecting means comprises a reflection light member mounted in said frame in alignment with a hole in said ram and said wire-crimping member.

3. A wire-crimping device as claimed in claim 1, wherein the detecting means comprises a light-emitting member mounted in said frame in alignment with a hole in said ram and said wire-crimping member, and a light-receiving member mounted on said frame in alignment with the hole in the wire-crimping member.

4. A wire-crimping device as claimed in claim 1, wherein the detecting means comprises a proximity sensor which is mounted in said frame adjacent the wire-crimping member in the proximity of the wire depressor.

5. A wire-crimping device as claimed in claim 1, wherein the detecting means comprises a limit switch mounted on the frame and having an arm provided with a roller thereon, said wire depressor having a protrusion along which said roller moves thereby operating said limit switch.

6. A wire-crimping device as claimed in claim 1, wherein said wire-crimping member includes an insulation crimper and a wire crimper, said wire depressor being disposed between said insulation crimper and said wire crimper.

* * * * *